US006315064B1

(12) United States Patent
Massa et al.

(10) Patent No.: US 6,315,064 B1
(45) Date of Patent: Nov. 13, 2001

(54) ROTATABLE CUTTING BIT ASSEMBLY WITH CUTTING INSERTS

(75) Inventors: Ted R. Massa, Latrobe; David R. Siddle, Greensburg, both of PA (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

(21) Appl. No.: 09/667,152

(22) Filed: Sep. 21, 2000

Related U.S. Application Data

(62) Division of application No. 09/224,397, filed on Dec. 31, 1998.

(51) Int. Cl.[7] ..... E21B 10/36
(52) U.S. Cl. ..... 175/420.1; 175/426; 175/418
(58) Field of Search ..... 175/417, 418, 175/420.1, 426, 427; 299/112

(56) References Cited

U.S. PATENT DOCUMENTS

| | | | | |
|---|---|---|---|---|
| 4,550,791 | * | 11/1985 | Isakov | 175/410 |
| 5,139,099 | * | 8/1992 | Hayashi et al. | 175/292 |
| 5,172,775 | * | 12/1992 | Sheirer et al. | 175/57 |
| 6,044,920 | * | 4/2000 | Massa et al. | 175/417 |
| 6,109,377 | * | 8/2000 | Massa et al. | 175/417 |

* cited by examiner

*Primary Examiner*—David Bagnell
*Assistant Examiner*—Jennifer R. Dougherty
(74) *Attorney, Agent, or Firm*—John J. Prizzi

(57) ABSTRACT

A rotatable cutting bit for penetrating an earth formation wherein the rotatable cutting bit includes an elongate bit body having a forward end and a rearward end. The bit body further defines a peripheral surface. The bit body has a first cutting insert affixed thereto at the axially forward end thereof. The first cutting insert has a first leading cutting edge and a first side clearance cutting edge. The first cutting insert is attached to the bit body so that the first side clearance cutting edge radially extends past the peripheral surface of the bit body so as to engage the earth formation.

3 Claims, 7 Drawing Sheets

ROTATABLE CUTTING BIT ASSEMBLY WITH CUTTING INSERTS

This is a divisional of prior application Ser. No. 09/224,397 filed Dec. 31, 1998.

BACKGROUND OF THE INVENTION

The expansion of an underground mine (e.g. a coal mine) requires digging a tunnel which initially has an unsupported roof. To stabilize and support the roof a roof bolt must be inserted into the roof to provide support. The operator must first drill holes in the roof through the use of a rotatable cutting bit or roof drill bit. A roof bolt is then inserted into each one of the holes.

A common roof drill bit design uses a cutting insert that has been brazed into a slot at the axially forward end of the roof drill bit body. U.S. Pat. No. 5,400,861 to Sheirer discloses various roof drill bits. U.S. Pat. No. 4,603,751 Erickson also discloses various roof drill bits. Applicants hereby incorporate U.S. Pat. No. 4,603,751 and U.S. Pat. No. 5,400,861 by reference herein. In addition, the following catalogs published by Kennametal Inc. of Latrobe, Pa. (U.S.A.), which are hereby incorporated by reference herein, disclose roof drill bits: "Kennametal Mining Products", Catalog A96-55(15)H6 (September 1996) [36 pages in length], and "Kennametal Mining Products" Catalog B92-75R(3)M5 (1992) [36 pages in length]. Furthermore, copending U.S. patent application Ser. No. 09/108,181 filed on Jul. 1, 1998 by Massa and Siddle and copending U.S. patent application Ser. No. 08/893,059 filed on Jul. 15, 1997 by Massa and Siddle disclose roof drill bits and cutting inserts for roof drill bits. These two patent applications (Ser. Nos. 08/893,059 and 09/108,181) are hereby incorporated by reference herein.

While the above roof drill bits and the cutting inserts for such roof drill bits have provided satisfactory performance characteristics, there remains room for improvement of the overall performance, as well as room for improvement of certain features of the roof drill bits and the cutting inserts therefor. In this regard, applicants believe that it would be desirable to provide for an improved rotatable cutting bit (e.g., roof drill bit), as well as the cutting insert for the rotatable cutting bit, that presents a cutting insert which has cutting edges with increased strength over earlier cutting inserts.

SUMMARY OF THE INVENTION

In one form thereof, the invention is a rotatable cutting bit for penetrating an earth formation. The rotatable cutting bit comprises an elongate bit body having a forward end and a rearward end. The bit body further defines a peripheral surface. The bit body has a first cutting insert affixed thereto at the axially forward end thereof. The first cutting insert has a first leading cutting edge and a first side clearance cutting edge. The first cutting insert is attached to the bit body so that the first side clearance cutting edge radially extends past the peripheral surface of the bit body so as to engage the earth formation. At least a portion of the first leading cutting edge is arcuate.

In another form thereof, the invention is a rotatable cutting bit for penetrating an earth formation. The rotatable cutting bit comprises an elongate bit body having a forward end and a rearward end. The bit body defines a peripheral surface. The bit body has a first cutting insert attached to the bit body at the axially forward end thereof. The first cutting insert presents a first leading cutting edge and a first side clearance cutting edge. The first cutting insert is attached to the bit body so that the first side clearance cutting edge radially extends past the peripheral surface of the bit body so as to engage the earth formation. The first leading cutting edge has a radially inward portion and a radially outward portion wherein the radially inward portion is disposed at an angle with respect to the radially outward portion.

In still another form thereof, the invention is a cutting insert for use in a rotatable cutting bit for the penetration of an earth formation wherein the cutting insert is disposed in a seat in the cutting bit with a peripheral surface. The cutting insert comprises a cutting insert body that has a top surface, a bevelled surface, and a leading surface. The leading surface and the top surface intersect so as to form a leading cutting edge at the intersection thereof. The bevelled surface and the leading surface intersect so as to form a side clearance cutting edge at the intersection thereof. The leading cutting edge has at least a portion thereof being arcuate.

BRIEF DESCRIPTION OF THE DRAWINGS

The following is a brief description of the drawings that form a part of this patent application.

DETAILED DESCRIPTION

Figure 2:
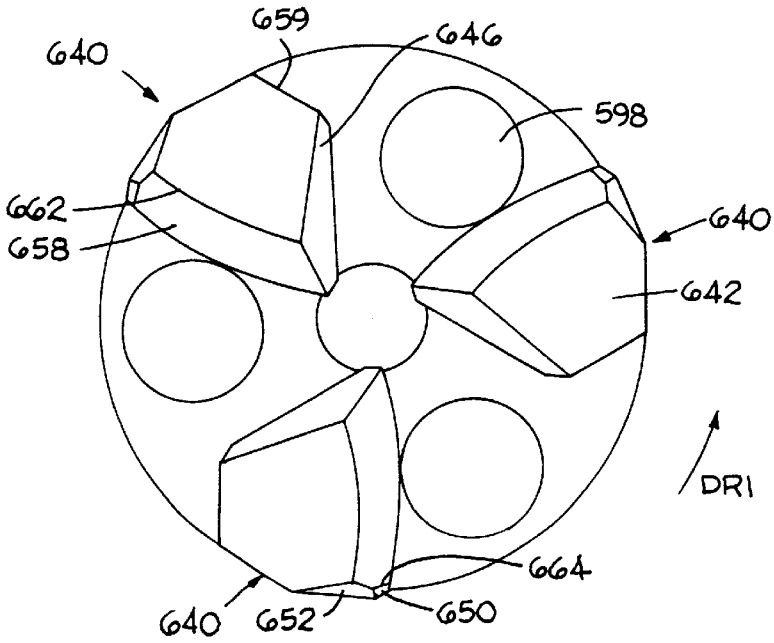
FIG. 2 is a top view of the rotatable cutting bit of FIG. 1.
Figure 1:
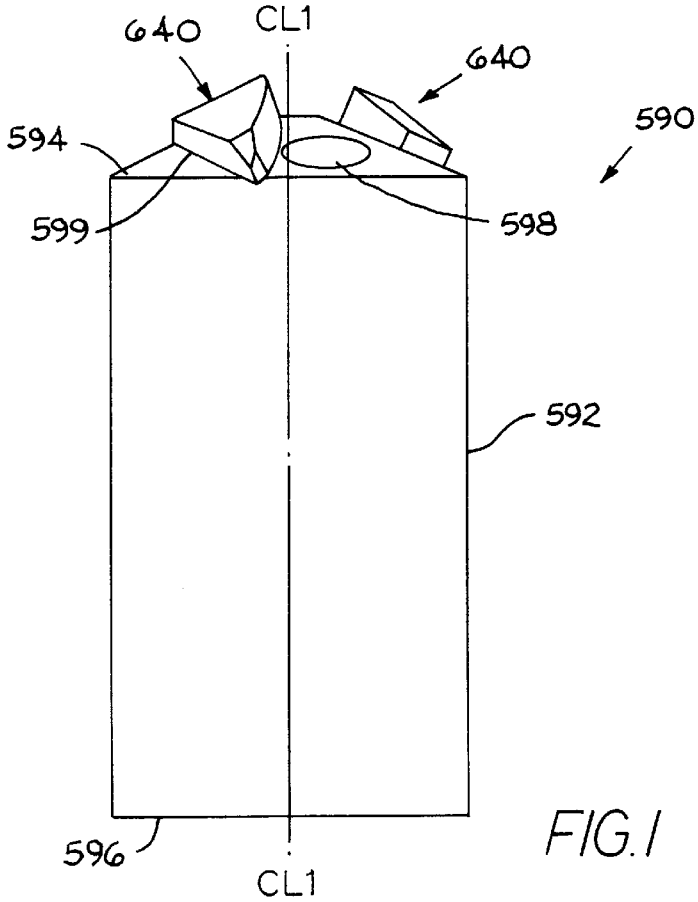
FIG. 1 is a side view of a rotatable cutting bit, i.e., a roof drill bit, that includes a cutting insert which has a generally arcuate leading surface and a generally planar top surface.

Referring to the drawings, and especially FIGS. 1 and 2, there is shown a specific embodiment of a rotatable cutting bit (and specifically a roof drill bit) generally designated as 590. Roof drill bit 590 includes an elongate bit body 592 which is typically made of steel. Roof drill bit 592 has an axially forward end 594 and an opposite axially rearward end 596. The bit body 592 has a central longitudinal axis CL1—CL1 (see FIG. 1) and when in operation has a direction of rotation indicated by the arrow identified as "DR1" (see FIG. 2).

The axially forward end 594 presents a generally frustoconical shape. The body 592 contains a plurality of debris evacuation passages (or vacuum ports) 598 at the axially forward end 594 of the elongate body 592. These passages 598 provide communication between the interior bore, or cavity, (not illustrated) and the axially forward end 594 of the bit body 592. Although the specific embodiment illustrates a trio of equi-spaced peripheral debris evacuation passages and one central debris evacuation passage, applicants contemplate that any number of passage(s) in a suitable orientation or a single passage could be appropriate. Although it would depend upon the specific application, applicants also contemplate that the cutting bit body may not include any debris evacuation passages.

Although the primary focus of the specific embodiment is upon dry drilling (i.e., drilling the earth strata without using any coolant or the like) operations, applicants still contemplate that the present roof bit may be used in a wet drilling operation. In a wet drilling operation, the passages would function to provide a pathway for a flow of fluid (e.g., water) to the forward end of the bit body, i.e., fluid would flow through the passages. Applicants also contemplate that for a wet drilling operation, the outside surface of the bit body may contain flats, or some other relief in the surface, so as to provide a passage for the fluid and debris to exit from near the cutting inserts.

It should be appreciated that the debris evacuation passages 598 are in close proximity to the cutting inserts. During the dry drilling operation, the debris evacuation passages bring cool (or at least cooler) air to the cutting inserts so that this cooler air swirls up and around the cutting inserts as the air is suctioned into the passages 598. Because the cutting insert, and of course the cutting edges, are in the path of these swirling air currents, the cutting inserts and the cutting edges remain at a cooler temperature. By being kept at this lower temperature, the material of the cutting inserts (e.g., cobalt cemented tungsten carbide) better retains its strength and hardness which is in contrast to a cutting insert of a roof drill bit that has debris evacuation passages remote from the vicinity of the cutting inserts. Remote debris evacuation passages provide very little, if any, cooling effect due to the swirling air in the vicinity of the cutting inserts.

The elongate bit body 592 also contains a trio of seats 599 wherein each seat 599 receives its respective cutting insert 640. Although the specific embodiment of FIGS. 1 and 2 shows three seats and three corresponding cutting inserts, there is no intention to limit the invention to the use of three cutting inserts (and seats). Applicants contemplate that the invention would function with two or more cutting inserts (and seats). The dimension of the cutting bit body and the cutting inserts, as well as the particular cutting application, are factors which would influence the number of cutting inserts (and seats) presented by the rotatable cutting bit. In regard to the orientation of the seats 599, the seats 599 have an orientation that is like that for seats as shown in FIGS. 22 and 23 in pending U.S. patent application Ser. No. 09/108,181, which has already been incorporated by reference herein.

Figure 4:
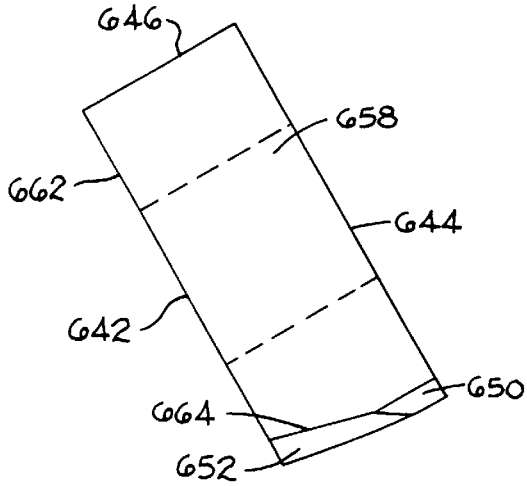
FIG. 4 is a front view (view 4—4) of the cutting insert of FIG. 3.
Figure 3:
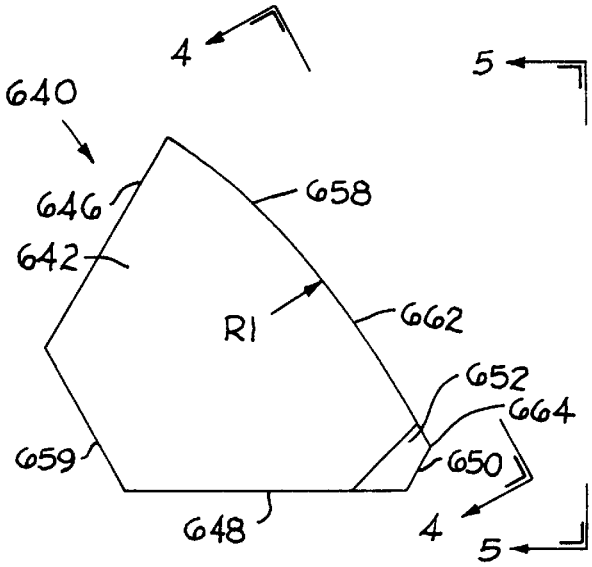
FIG. 3 is a top view of the cutting insert which is used in the rotatable cutting bit of FIGS. 1 and 2.
Figure 5:
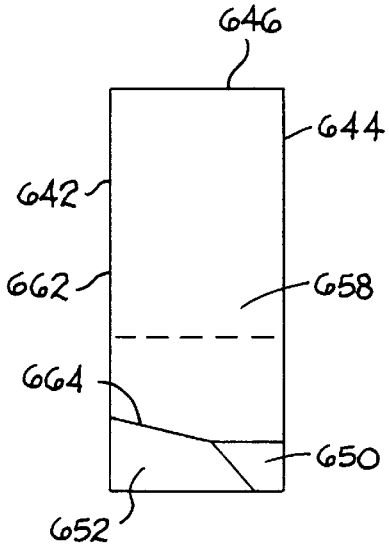
FIG. 5 is a side view (view 5—5) of the cutting insert of FIG. 3.
Figure 6A:
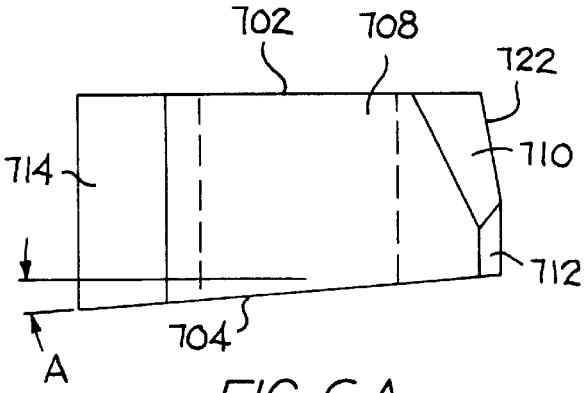
FIG. 6A is a bottom view (view 6A—6A) of the cutting insert of FIG. 6.
Figure 7:
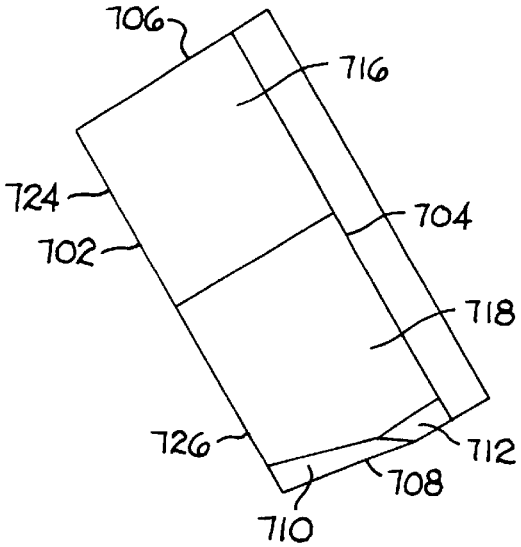
FIG. 7 is a front view (view 7—7) of the cutting insert of FIG. 6.
Figure 6:
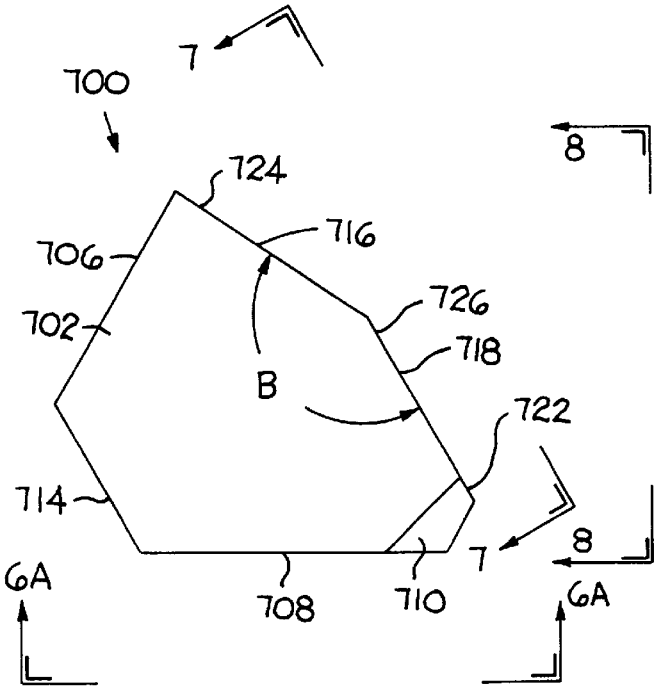
FIG. 6 is a top view of another specific embodiment of a cutting insert having a leading surface that presents a pair of generally planar portions, and a generally planar top surface.
Figure 8:
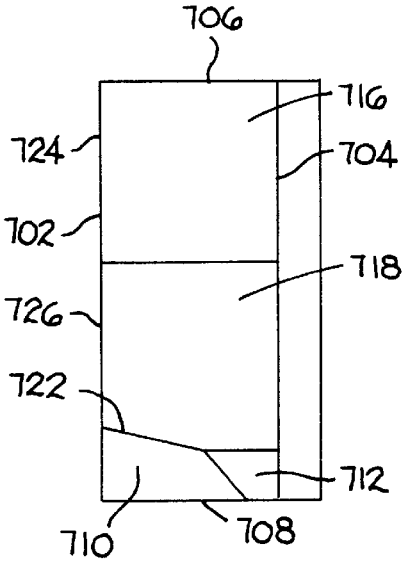
FIG. 8 is a side view (view 8—8 of the cutting insert of FIG. 6.

Referring to FIGS. 3 through 5, which illustrate the details of the cutting insert 640, each cutting insert 640 is the same so that the following description of one such cutting insert will suffice for a description of all these cutting inserts 640. It should be appreciated that even though the cutting inserts 640 are the same in cutting bit 590, applicants contemplate that there may be instances in which the cutting inserts may be different in that a cutting bit may carry two or more different cutting inserts. Cutting insert 640 is typically made from a cemented carbide such as, for example, cobalt cemented tungsten carbide. For this cutting insert the cobalt may range between about 2 weight percent and about 20 weight percent with the balance being tungsten carbide. It should be appreciated, however, that other materials suitable for use as a cutting insert may also be appropriate to use for the cutting insert. These materials include ceramics (e.g., silicon nitride-based ceramics, and alumina-based ceramics), binderless tungsten carbide, polycrystalline diamond composites with metallic binder, polycrystalline diamond composites with ceramic binder, tungsten carbide-cobalt alloys having a hardness greater than or equal to about 90.5 Rockwell A, and hard coated cemented carbides.

The cutting insert 640 is affixed by brazing to the seat of the cutting bit body 592. As will become apparent from the following description and is apparent from the drawings, the surface area of the bottom surface of the cutting insert greater than the surface area of the leading surface. The bottom surface provides the major area for brazing the cutting insert 640 to the cutting bit body 592. By using the larger bottom surface to form the braze joint, the cutting insert can be brazed to the cutting bit body using a relatively shallow seat that does not require a large shoulder. The use of such a shallow seat may reduce the expense associated with the manufacture of the cutting bit body.

One preferred braze alloy for brazing cutting insert 640 to the seat of the bit body is HANDY HI-TEMP 548 braze alloy available from Handy & Harman, Inc., 859 Third Avenue, New York, N.Y. 10022. HANDY HI-TEMP 548 braze alloy is composed of 55±1.0 weight percent Cu, 6±0.5 weight percent Ni, 4±0.5 weight percent Mn, 0.15±0.05 weight percent Si, with the balance zinc and 0.50 weight percent maximum total impurities. Further information on HANDY HI-TEMP 548 braze alloy can be found in Handy & Harman Technical Data Sheet No. D-74 available from Handy & Harman, Inc.

Each cutting insert 640 may have an orientation to the bit body 592 when brazed thereto like the orientation of cutting insert 60 to the bit body 32 as illustrated in FIGS. 1 and 2 of pending U.S. patent application Ser. No. 08/108,181, which has already been incorporated by reference herein. Furthermore, the range of possible orientations of cutting insert 60 to bit body 32 of pending U.S. patent application Ser. No. 09/108,181 is also available for the orientation of the cutting insert 640 to the bit body 592.

Figure 13:
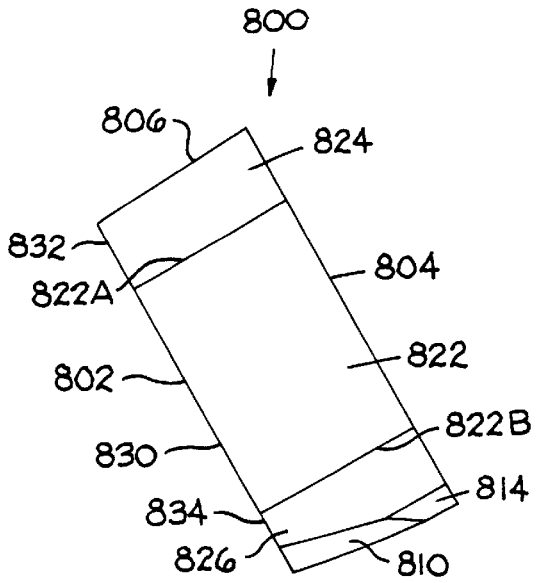
FIG. 13 is a front view (view 13—13) of the cutting insert of FIG. 12.
Figure 12:
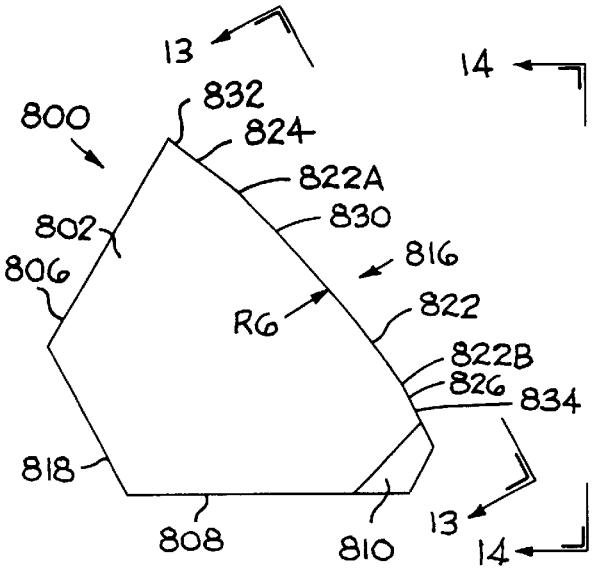
FIG. 12 is a top view of another cutting insert which has a generally planar top surface and a leading surface which presents a mediate generally arcuate portion and a generally planar surface at either end of the mediate generally arcuate portion.
Figure 14:
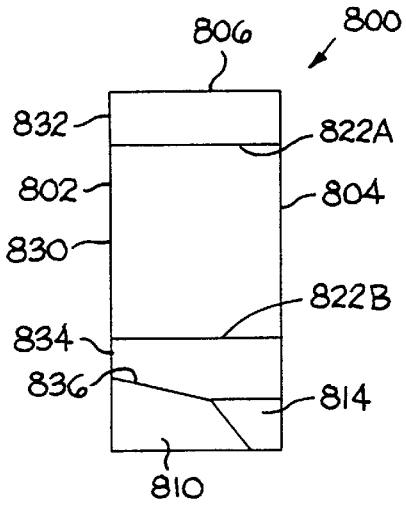
FIG. 14 is a side view (view 14—14) of the cutting insert of FIG. 12.

Cutting insert 640 includes a generally planar (or flat) top surface 642 and a generally planar (or flat) bottom surface 644 wherein the top and bottom surfaces are generally parallel to one another. The cutting insert further includes an interior side surface 646, an exterior side surface 648, a bevelled exterior side surface 652 and a straight exterior side surface 650. The cutting insert 640 also includes an arcuate leading surface 658 and an opposite trailing surface 659. The arcuate leading surface 658 presents a radius of curvature Rl. While the arcuate leading surface 658 shown in FIGS. 3–5 presents a constant radius of curvature R1 (see FIG. 3), applicants contemplate that the radius of curvature of the leading surface may vary or that the leading surface may contain a combination of arcuate and planar portions. Such a combination of an arcuate portion and a pair of planar portions is illustrated in FIGS. 12–14, which is described hereinafter.

The generally planar top surface 642 intersects the arcuate leading surface 658 to form an arcuate leading cutting edge 662. The arcuate leading cutting edge 662 presents an arcuate shape due to the arcuate shape of the leading surface 658. The arcuate leading surface 658 intersects the bevelled exterior side surface 652 to form the generally straight side clearance cutting edge 664.

In operation, the leading cutting edge 662 first impinges the earth strata while the side clearance cutting edge 664 cuts the outside of the hole. The exterior surface 650 must present a certain degree of relief in order for the cutting bit to properly function. However, the interior surface 646 does not have to present any relief since the interior surface 646 does not contact (or come close to contacting) the side wall of the bore hole. By the interior surface 646 not presenting any relief, the bottom surface presents a larger surface area for brazing.

Referring to FIGS. 6, 6A, 7 and 8, there is illustrated another specific embodiment of a cutting insert generally designated as 700. Cutting insert 700 may be made from the same materials as cutting insert 640. Cutting insert 700 includes a generally planar top surface 702 and a generally planar bottom surface 704. The cutting insert 700 presents an interior side surface 706, an exterior side surface 708, a bevelled exterior side surface 710, and a straight exterior side surface 712. The cutting insert 700 further includes a generally planar interior leading surface 716, a generally planar exterior leading surface 718 and a generally planar trailing surface 714. The bottom surface 704 diverges at an included angle "A" (e.g., 5 degrees) away from the top surface 702 as the bottom surface 704 moves from the leading surfaces (716, 718) to the trailing surface 714. As a result, the thickness of the cutting insert increases as it moves from the leading surfaces to the trailing surface. Although the thickening of the cutting insert 700 occurs in a cutting insert with two planar leading surfaces, applicants contemplate that a cutting insert which presents a leading surface with at least a portion thereof being arcuate and/or a top surface with a portion thereof being arcuate may also present a varying thickness such as that of cutting insert 700.

The exterior leading surface 718 is radially outward of the interior leading surface 716. The interior leading surface 716 and the exterior leading surface 718 intersect each other and are disposed with respect to one another at an included angle B. Referring to the specific embodiment, the angle B equals about 155 degrees. The preferred range for included angle B is between about 135 degrees and about 175 degrees. The more preferred range for included angle B is between about 145 degrees and about 165 degrees. The most preferred range for included angle B is between about 150 degrees and about 160 degrees.

The exterior leading surface 718 intersects the bevelled exterior side surface 710 to form the side clearance cutting edge 722 which is a generally straight cutting edge. The exterior leading surface 718 intersects the top surface 702 to form a generally straight exterior leading cutting edge 726. The interior leading surface 716 intersects the top surface 702 to form a generally straight interior leading cutting edge 724.

In operation, it should be appreciated that the side clearance cutting edge 722 cuts the side of the hole while the other cutting edges, i.e., interior leading cutting edge 724 and the exterior leading cutting edge 726, cut the balance of the hole. Because of the orientation of the cutting insert 700 in the seat of the cutting bit body, the interior leading cutting edge 724 first contacts the earth strata in the drilling (or cutting) operation.

Figure 10:
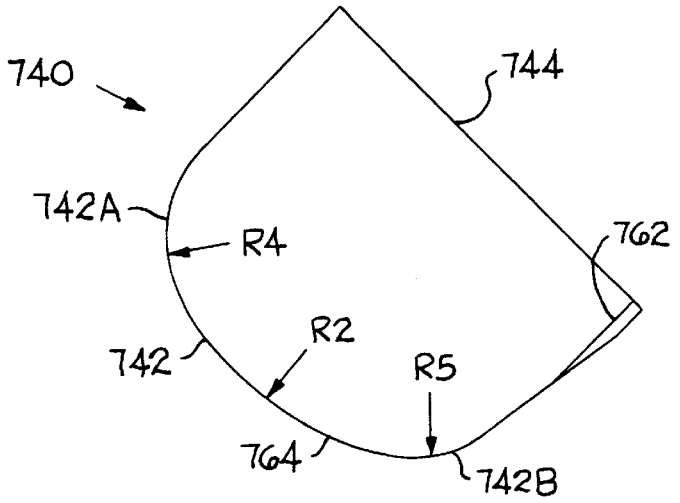
FIG. 10 is a front view (10—10) of the cutting insert of FIG. 9.
Figure 9:
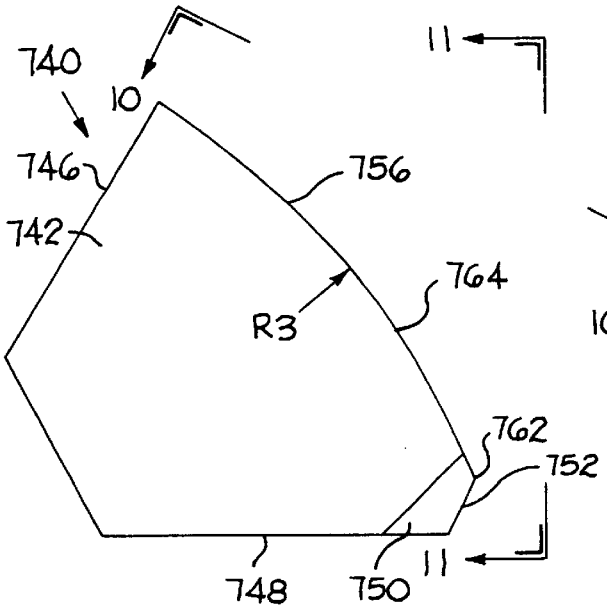
FIG. 9 is a top view of another specific embodiment of a cutting insert which has a generally arcuate leading surface and a generally arcuate top surface.
Figure 11:
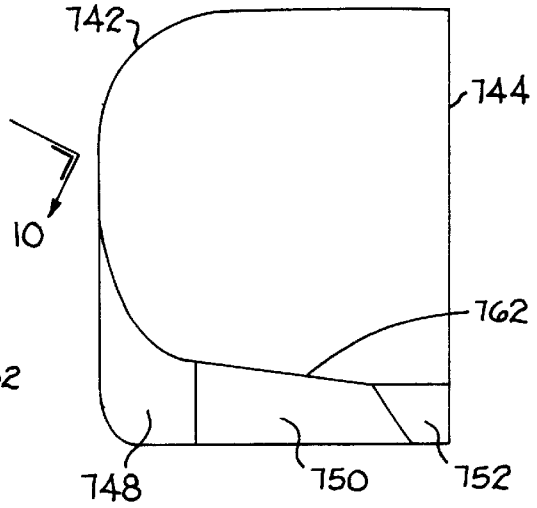
FIG. 11 is a side view of (11—11) the cutting insert of FIG. 9.

Referring to FIGS. 9 through 11, there is illustrated another embodiment of a cutting insert generally designated as 740, which may be made from the same materials as cutting insert 640. Cutting insert 740 includes an arcuate top surface 742 and a generally planar bottom surface 744. The arcuate top surface 742 has a radius of curvature R2. The top surface 742 has an interior arcuate portion 742A with a radius of curvature R4, and an exterior arcuate portion 742B with a radius of curvature R5. The radius of curvature R2 is greater than the radius of curvature R4 or the radius of curvature R5. In the drawings, radius of curvature R4 is equal to radius of curvature R5. However, it should be appreciated that there may be instances in which the radius of curvature R4 does not equal radius of curvature R5. In such a circumstance, it is most likely that radius of curvature R4 will be less than radius of curvature R5. Because of the arcuate nature of the top surface, the top and bottom surfaces (742 and 744) are not parallel to one another.

The cutting insert 740 also contains an interior surface 746, an exterior side surface 748, a bevelled exterior side surface 750, and a straight exterior surface 752. The cutting insert 740 further includes an arcuate leading surface 756. The arcuate leading surface 756 has a radius of curvature R3.

The leading surface 756 intersects the bevelled exterior surface 750 to form a side clearance cutting edge 762. The top surface 742 intersects the leading surface 756 to form the leading cutting edge 764. The leading cutting edge 764 is arcuate due to the arcuate nature of the leading surface 756 and top surface 742.

In operation, the side clearance cutting edge 762 cuts the side of the hole and the leading cutting edge 764 cuts the rest of the hole. It should be appreciated that the interior portion of the leading cutting edge 764 first contacts the earth strata.

Referring to FIGS. 12 through 14, there is illustrated another specific embodiment of a cutting insert generally designated as 800, which may be made from the same material as cutting insert 640. Cutting insert 800 includes a generally planar (or flat) top surface 802 and a generally planar (or flat) bottom surface 804 wherein the top and bottom surfaces are generally parallel to one another. The cutting insert further includes an interior side surface 806, an exterior side surface 808, a bevelled exterior side surface 810 and a straight exterior side surface 814. The cutting insert 800 also includes a leading surface 816 and an opposite trailing surface 818.

The leading surface 816 includes a mediate arcuate portion 822. The mediate arcuate portion 822 is positioned between and integral with an interior planar leading surface 824 and a exterior planar leading surface 826. The mediate arcuate portion 822 presents a radius of curvature R6. The mediate arcuate portion 822 has an interior termination line designated as 822A and an exterior termination line designated as 822B.

The generally planar top surface 802 intersects the mediate arcuate portion 822 to form an arcuate leading cutting edge 830. The arcuate leading cutting edge 830 presents an arcuate shape due to the arcuate shape of the mediate arcuate portion 822 of the leading surface 816. The top surface 802 intersects the interior leading surface 824 and the exterior leading surface 826 to form an interior straight leading cutting edge 832 and an exterior straight leading cutting edge 834, respectively. The exterior planar leading surface 826 intersects the bevelled exterior side surface 810 to form the generally straight side clearance cutting edge 836.

In operation, the leading cutting edge portion, which comprise the interior straight cutting edge 832, the exterior straight cutting edge 834, and the mediate arcuate leading cutting edge 830, first impinges the earth strata while the side clearance cutting edge 836 cuts the out the side of the hole.

Figure 16:
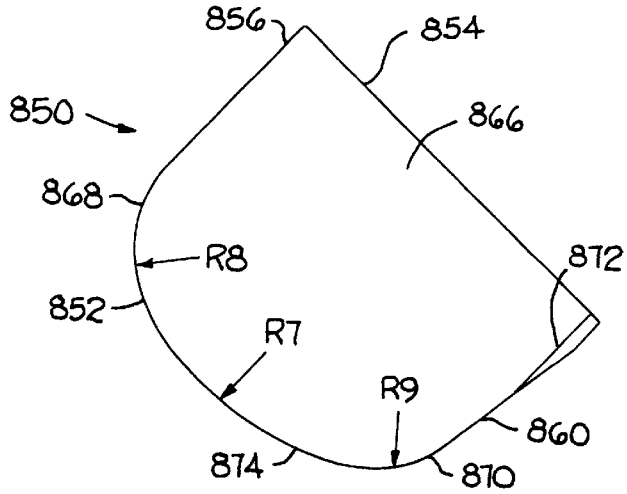
FIG. 16 is a front view (view 16—16) of the cutting insert of FIG. 15.
Figure 15:
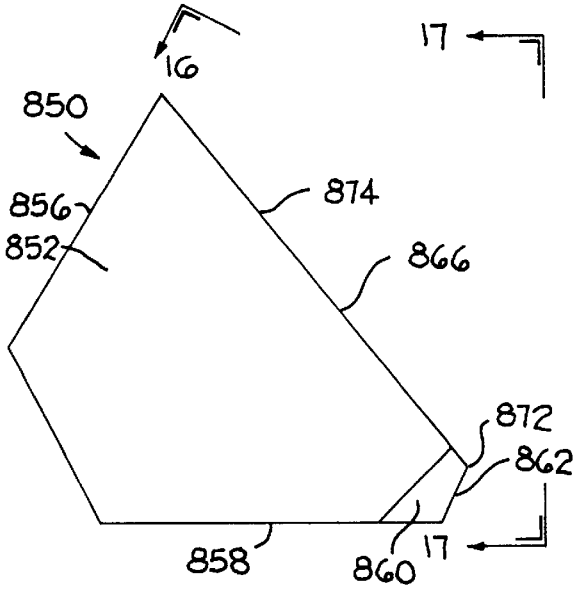
FIG. 15 is a top view of a cutting insert which has a generally arcuate top surface and a generally planar leading surface.
Figure 17:
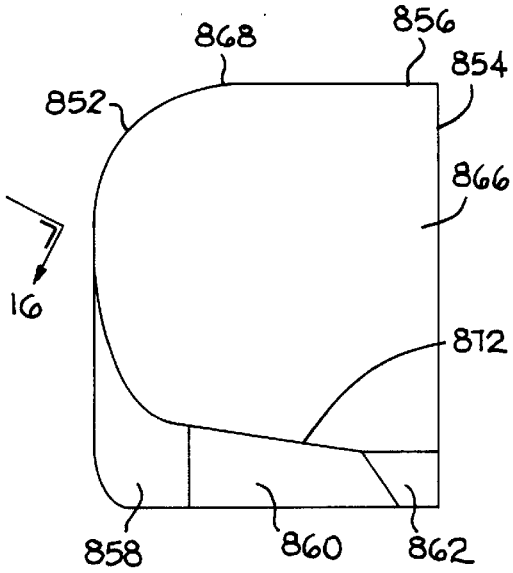
FIG. 17 is a side view (view 17—17) of the cutting insert of FIG. 15.

Referring to FIGS. 15 through 17, there is illustrated another embodiment of a cutting insert generally designated as 850, which may be made from the same materials as cutting insert 640. Cutting insert 850 includes an arcuate top surface 852 and a generally planar bottom surface 854. The arcuate top surface 852 has a radius of curvature R7. Because of the arcuate nature of the top surface, the top and bottom surfaces (852 and 854) are not parallel to one another.

The cutting insert 850 also contains an interior surface 856, an exterior side surface 858, a bevelled exterior side surface 860, and a straight exterior surface 862. The cutting insert 850 further includes a generally planar leading surface 866. The top surface 852 has an interior arcuate portion 868 with a radius of curvature R8, and an exterior arcuate portion 870 with a radius of curvature R9. The radius of curvature R7 is greater than the radius of curvature R8 and the radius of curvature R9. The drawings illustrate that the radius of curvature R8 is equal to radius of curvature R9; however, there may be instances in which the radius of curvature R8 does not equal radius of curvature R9. In such a circumstance, it is most likely that radius of curvature R8 is less than radius of curvature R9.

The leading surface 866 intersects the bevelled exterior surface 860 to form a side clearance cutting edge 872. The top surface 852 intersects the leading surface 866 to form an arcuate leading cutting edge 874. The leading cutting edge 874 is arcuate due to the arcuate nature of the top surface 852

In operation, the side clearance cutting edge 872 cuts the side of the hole and the leading cutting edge 874 cuts the rest of the hole. It should be appreciated that the interior arcuate portion 868 of the leading cutting edge 874 first contacts the earth strata.

Figure 19:
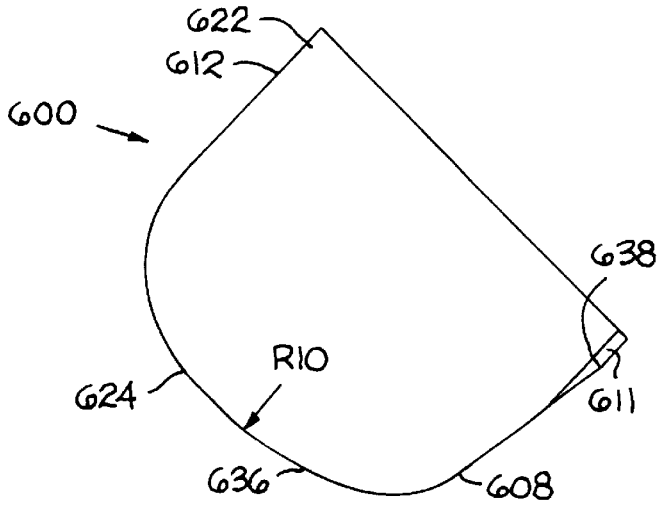
FIG. 19 is a front view (view 19—19) of the cutting insert of FIG. 18.
Figure 18:
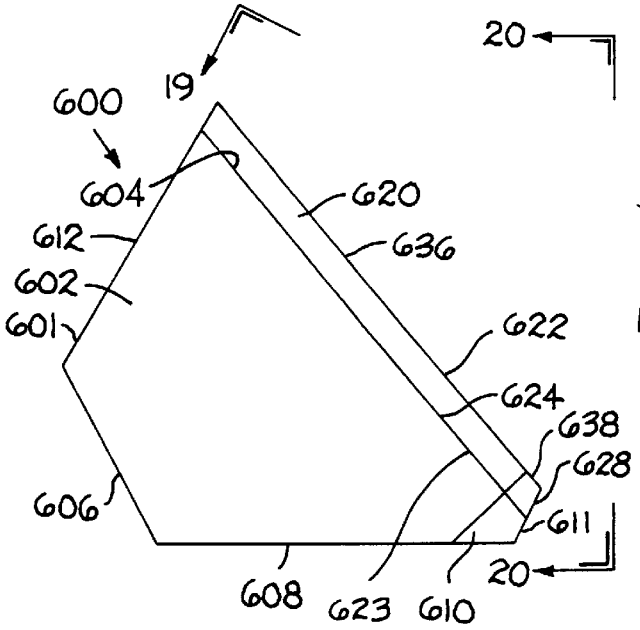
FIG. 18 is a top view of a cutting insert which has a generally arcuate top surface and a generally planar leading surface wherein the planar surface has a layer of polycrystalline diamond (PCD) thereon.
Figure 20:
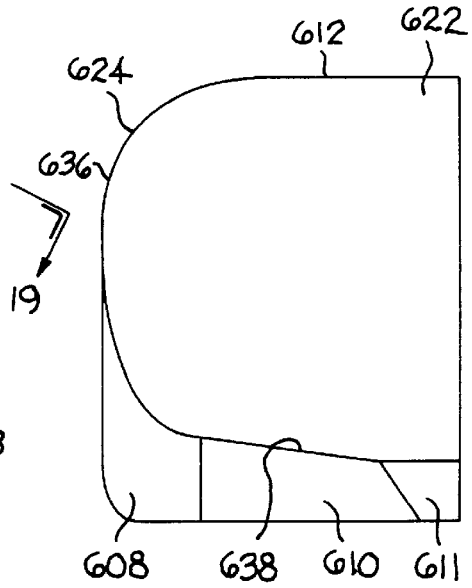
FIG. 20 is a side view (view 20—20) of the cutting insert of FIG. 18.

Referring to FIGS. 18 through 20, there is shown another cutting insert generally designated as 600. Cutting insert 600 includes a backing 601 wherein the backing 601 is typically made of a cemented carbide material such as, for example, cobalt cemented tungsten carbide. More specifically, the cobalt cemented tungsten carbide material may have a cobalt content that ranges between about 2 weight percent and about 20 weight percent with the balance being tungsten carbide.

The cutting insert backing 601 presents an arcuate top surface 602, a generally planar leading surface 604, and a trailing surface 606. The arcuate top surface 602 presents a radius of curvature R10. Although the radius of curvature R10 is shown as being constant, it should be appreciated that the arcuate top surface 602 may present a curvature wherein the radius of curvature may vary such as, for example, like that of the cutting insert of FIGS. 15–17. The cutting insert backing 601 further presents an exterior side surface 608, a bevelled exterior side surface 610, and an exterior straight side surface 611. The cutting insert backing 601 also includes an interior side surface 612. The use of the terms "interior" and "exterior" are intended to refer to the position of the recited feature relative to the central longitudinal axis of the cutting bit. This means that the exterior surfaces (608, 610) are radially outwardly of the interior surface (612).

The cutting insert 600 further includes a layer of polycrystalline diamond 620. The polycrystalline diamond layer includes a generally planar leading face 622, a trailing face 623, and an arcuate top surface 624. In order to correspond with the leading surface 604 of the backing 601, the arcuate top surface 624 of the PCD layer 620 has a radius of curvature that is the same as that of the arcuate top surface 602 of the backing. The polycrystalline diamond layer 620 further includes a bevelled exterior side surface 628 and a straight exterior side surface 629. The top surface 624 intersects with the leading face 622 of the PCD layer 620 so as to present an arcuate leading cutting edge 636 at the intersection thereof. The bevelled exterior surface 628 intersects with the leading face 622 of the PCD layer 620 so as to present a side clearance cutting edge 638 at the intersection thereof. The side clearance cutting edge 638 is a straight cutting edge.

The backing 601 is preferably about seven times, and even more preferably about ten times, thicker than the layer of polycrystalline diamond layer 620. The higher ratio of the thickness of the cemented carbide backing to the thickness of the polycrystalline diamond layer results in an increase in the strength of the overall cutting insert. A stronger cutting insert will typically result in a longer operating life and a reduction in the instances of premature failures.

The cutting insert 600 is affixed by brazing to the seat of a cutting bit body. The surface area of the bottom surface of the backing 601 is greater than the surface area of the leading surface 604. The bottom surface of the backing 601 provides the major area for brazing the cutting insert 600 to the cutting bit body. The polycrystalline diamond layer is on the leading surface of the backing, which is adjacent to, as well as perpendicular to, the bottom surface of the backing. The leading surface has a smaller surface area than the bottom surface, and the braze joint is between the bottom surface of the backing and the seat.

By using the larger bottom surface to form the braze joint in conjunction with the polycrystalline diamond layer being on the smaller leading surface, the cutting insert can be brazed to the cutting bit body using a relatively shallow seat that does not require a large shoulder. The use of such a shallow seat may reduce the expense associated with the manufacture of the cutting bit body.

The cutting edges of the polycrystalline layer are removed such a distance from the surface which forms the braze joint. These cutting edges thus are not negatively impacted by the higher temperatures which occur during manufacture of the cutting bit.

During the post-brazing cooling of the cutting insert and cutting bit body, stresses are formed due to the difference in the coefficient of thermal expansion between the cemented tungsten carbide backing and the steel cutting bit body. The steel body contracts to a greater extent than the cemented carbide so as to set up tension in the surface of the backing that is opposite to the surface which forms the braze joint.

Because the polycrystalline diamond layer is on a surface which is perpendicular to the bottom surface which forms the braze joint, the polycrystalline diamond layer does not experience post-brazing stresses to the same extent as in earlier cutting bits in which the polycrystalline layer is on the surface of the backing opposite to that surface which forms the braze joint. The reduction of the stress on the surface which has the polycrystalline layer promotes a longer operating life of the tool.

As discussed above, due to the improved air flow at the-cutting inserts, this rotatable cutting bit (i.e., roof drill bit) cuts at a lower temperature, i.e., cooler, than earlier bits, a lower temperature braze alloy is appropriate to use to braze the cutting insert to the bit body. One acceptable type of such a braze alloy is a low temperature silver-based braze alloy which is suitable for the joinder of steel and cobalt cemented tungsten carbide. One preferred such braze alloy is the silver-based braze alloy sold under the designation EASY-FLO 45 by Handy & Harman of New York, N.Y. (USA). This braze alloy has a composition of 15 weight percent copper, 16 weight percent zinc, 45 weight percent silver, and 24 weight percent cadmium, and a melting point of 1125° F.

It should be appreciated that the backing 601 now presents a geometry that has sufficient relief so as to not interfere with the cutting by the cutting edges of the polycrystalline diamond layer 620. In other words, the backing 601 does not directly impinge upon the earth strata during the cutting (e.g., drilling) operation. In this regard, the exterior surface 608 must have a sufficient relief so as to not directly impinge upon the earth strata. It should be appreciated that while the exterior surface 608 must present a certain degree of relief, the interior surface 612 does not have to have any relief so as to maximize the mass of the backing, if necessary to thereby be suitable for a particular application.

Still referring to FIGS. 18 through 20, it can be appreciated that the leading cutting edge 636 and the side clearance cutting edge 638 comprise the cutting edges that engage the earth strata during the operation of the rotatable cutting bit. More specifically, the leading cutting 636 first engages the earth strata while the side clearance cutting edge 638 cuts the side clearance for the hole. It should be appreciated that these cutting edges (636 and 638) are preferably honed or chamfered at the intersection of the surfaces. The presence of such a hone or chamfer will reduce the potential for chipping or cracking of the polycrystalline diamond layer at these intersections.

Tests were conducted to compare the cutting performance (including the temperature of the cutting insert) of a one inch diameter roof drill bit using a cutting insert depicted in FIGS. 32–34 of U.S. patent application Ser. No. 09/108,181 against a conventional roof drill bit in a dry (or vacuum) drilling operation. The conventional roof drill bit was a KCV4-1RR with a one inch diameter as made by Kennametal Inc. The cutting insert for each roof drill bit was made of the same grade of cobalt cemented tungsten carbide. In Tables I through III the term "Drill Bit" refers to the type of drill bit wherein "Conv" refers to the KCV4-1RR roof drill bit and the term "Inv." refers to the drill bit of FIGS. 32–34 in U.S. patent application Ser. No. 09/108,181.

Table I through Table III set forth below present the results of these comparative tests in three different materials, i.e., hard sandstone, limestone, and granite.

TABLE I

Drilling Results in Hard Sandstone for KCV4-1RR Roof Drill Bit Against Roof Drill Bit According to FIGS. 32–34 of Ser. No. 09/108,181

| Drill Bit | Holes | Overall Depth | Avg. Feed | Initial Feed | Final Feed | Thrust | RPM | Temp. (° F.) |
|---|---|---|---|---|---|---|---|---|
| Conv. 1 | 1 | 5.4 | 0.11 | 0.24 | 0.06 | 3500 | 400 | 697 |
| Conv. 2 | 1 | 0.6 | 0.08 | 0.17 | 0.03 | 2900 | 500 | n/a |
| Conv. 3 | 1 | 2.6 | 0.11 | 0.48 | 0.01 | 2500 | 400 | 542 |
| Conv. 4 | 1 | 1.1 | 0.04 | 0.11 | 0.02 | 1700 | 400 | 337 |
| Inv. 1 | 1 | 10.2 | 1.66 | 1.62 | 1.62 | 2900 | 500 | n/a |
| Inv. 2 | 1 | 29.7 | 1.44 | 1.35 | 0.79 | 2500 | 400 | 244 |
| Inv. 3 | 2 | 47.5 | 0.25 | 0.33 | 0.14 | 1700 | 400 | 242 |
| Inv. 4 | 3 | 88.1 | 0.57 | 0.59 | 0.33 | 2000 | 500 | 312 |
| Inv. 5 | 3 | 89.3 | 1.05 | 1.33 | 1.01 | 2500 | 400 | 331 |
| Inv. 6 | 1 | 30.4 | 1.19 | 1.33 | 1.17 | 2500 | 400 | 319 |
| Inv. 7 | 3 | 88.5 | 0.22 | 0.25 | 0.19 | 1700 | 400 | 240 |
| Inv. 8 | 4 | 120.2 | 0.64 | 0.98 | 0.72 | 2500 | 400 | 326 |
| Inv. 9 | 2 | 58.8 | 0.37 | 0.34 | 0.34 | 2000 | 500 | 230 |
| Inv. 10 | 2 | 60.6 | 0.38 | 0.36 | 0.43 | 2000 | 400 | 246 |

TABLE II

Drilling Results in Limestone for KCV4-1RR Roof Drill Bit Against Roof Drill Bit According to FIGS. 32–34 of Ser. No. 09/108,181

| Drill Bit | Holes | Overall Depth | Avg. Feed | Initial Feed | Final Feed | Thrust | RPM | Temp (° F.) |
|---|---|---|---|---|---|---|---|---|
| Conv. 1 | 1 | 29.4 | 0.51 | 0.66 | 0.38 | 3000 | 400 | 337 |
| Conv. 2 | 2 | 44.8 | 0.2 | 0.26 | 0.13 | 2500 | 400 | 392 |
| Conv. 3 | 1 | 28.8 | 0.19 | 0.28 | 0.11 | 2000 | 400 | 301 |
| Inv. 1 | 5 | 143.3 | 0.96 | 1.17 | 0.78 | 3000 | 400 | 292 |
| Inv. 2 | 2 | 48.9 | 0.27 | 0.27 | 0.02 | 2000 | 400 | 270 |
| Inv. 3 | 10 | 287.8 | 0.21 | 0.29 | 0.17 | 2000 | 400 | 255 |
| Inv. 4 | 1 | 29.0 | 0.65 | 0.62 | 0.55 | 2000 | 400 | 240 |
| Inv. 5 | 1 | 1.5 | 0.17 | 0.51 | 0.02 | 2000 | 400 | n/a |
| Inv. 6 | 1 | 1.2 | 0.29 | 0.64 | 0.22 | 2000 | 400 | n/a |

TABLE III

Drilling Results in Granite for KCV4-1RR Roof Drill Bit Agaiast Roof Drill Bit Acccrding to FIGS. 32-34 of Ser. No. 09/108,181

| Drill Bit | Holes | Overall Depth | Avg. Feed | Initial Feed | Final Feed | Thrust | RPM | Temp (° F.) |
|---|---|---|---|---|---|---|---|---|
| Conv. 1 | 2 | 33.0 | 0.33 | 0.66 | 0.22 | 4000 | 400 | 586 |
| Conv. 2 | 1 | 4.4 | 0.14 | 0.35 | 0.02 | 2500 | 400 | 429 |
| Conv. 3 | 1 | 0.9 | 0.04 | 0.11 | 0.02 | 1750 | 400 | 292 |
| Conv. 4 | 1 | 2.5 | 0.10 | 0.15 | 0.02 | 2500 | 500 | 450 |
| Inv. 1 | 1 | 2.0 | n/a | 1.6 | n/a | 4000 | 400 | n/a |
| Inv. 2 | 5 | 136.6 | 0.38 | 0.58 | 0.29 | 2500 | 400 | 232 |
| Inv. 3 | 3 | 93.4 | 0.36 | 0.55 | 0.31 | 2500 | 500 | 298 |
| Inv. 4 | 2 | 61.4 | 0.20 | 0.13 | 0.16 | 2000 | 400 | 268 |
| Inv. 5 | 2 | 47.5 | 0.37 | 0.68 | 0.25 | 2500 | 400 | 325 |
| Inv. 6 | 2 | 62.4 | 0.31 | 0.6 | 0.27 | 2500 | 400 | 260 |
| Inv. 7 | 1 | 29.5 | 0.31 | 0.39 | 0.3 | 2500 | 400 | 365 |

For each one of Table I through Table III, the headings have the following meanings: the term "Holes" refers to the number of holes started with the roof drill bit in the material; the term "Overall Depth" means the total drilled depth of the holes in as measured in inches; the term "Avg. Feed" means the average feed rate in inches per second over the entire drilled depth of the hole; the term "Initial Feed" means the feed rate in inches per second at the very beginning of the first drilled hole; the term "Final Feed" means-the feed rate in inches per second at the end of the entire drilled depth; the term "Thrust" means the axial thrust force used to push the roof drill bit into the material as measured in pounds; the term "RPM" means the average rotational velocity of the roof drill bit during the drilling operation; and the term "Temp (°F.)" means the temperature of the cutting edge of the cutting insert after the roof drill bit has been removed from the hole.

Referring to the test results set forth in Table I for drilling in hard sandstone, it seems very apparent that the overall temperature of the cutting edge of the cutting inserts of the design of FIGS. 32–34 were lower than the temperature of the KCV4-1RR drill bit. In this regard, the temperatures (°F.) for the KCV4-1RR drill bit were 697, 542 and 337 as compared to the temperatures (°F.) of 244, 242, 312, 331, 319, 240, 326, 230 and 246. The same trend appears to exist for drilling in limestone (Table II) and drilling in granite (Table III) in that the temperature of the cutting edge of the cutting inserts for the drill bit of FIGS. 32–34 of Ser. No. 108,181 were lower than the temperatures of the cutting edges of the cutting inserts of the KCV4-R11 roof drill bit. As mentioned above, there are certain advantages associated with a roof drill bit that can drill at lower temperatures.

Although the specific embodiment is a roof drill bit, it should be appreciated that applicants contemplate that the invention encompasses other styles of rotatable cutting bits. One such example is a rotary percussive drill bit.

It should also be understood that although the specific embodiments set forth herein comprise roof drill bits for use in the penetration of earth strata, the principles set forth with respect to these cutting inserts also have application to metalcutting inserts, as well.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A rotatable cutting bit for penetrating an earth formation, the rotatable cutting bit comprising:

an elongate bit body having a forward end and a rearward end, the bit body defining a peripheral surface;

the bit body having a first cutting insert attached to the bit body at the axially forward end thereof, the first cutting insert presenting a first leading cutting edge and a first side clearance cutting edge;

the first cutting insert being attached to the bit body so that the first side clearance cutting edge radially extends past the peripheral surface of the bit body so as to engage the earth formation;

the first leading cutting edge having a radially inward portion and a radially outward portion, and the radially inward portion being disposed at an angle with the respect to the radially outward portion;

the first cutting insert includes a top surface and a leading surface, and the leading surface comprising a radially inward surface portion and a radially outward surface portion, and the top surface intersects with the radially inward leading surface portion as to define the radially inward portion of the leading cutting edge, and the top surface intersects with the radially outward leading surface portion so as to define the radially outward portion of the cutting edge; and the cutting insert further including a bevelled surface, and the leading surface and the beveled surface intersecting so as to form a side clearance cutting edge at the juncture thereof.

2. The rotatable cutting bit of claim 1 wherein the top surface is generally planar, and the bevelled surface is generally planar.

3. The rotatable cutting bit of claim 1 wherein the bit body containing a cavity, the bit body containing an unobstructed passage at the forward end thereof, and wherein the passage providing communication between the cavity and the axially forward end of the bit body.

* * * * *